US005119863A

United States Patent [19]

Okesaku et al.

[11] Patent Number: 5,119,863

[45] Date of Patent: Jun. 9, 1992

[54] WATER JET NOZZLE FOR LOOM

[75] Inventors: Masahiro Okesaku, 133-1, Ha, Minamiasai-machi, Komatsu-shi; Michito Miyahara, Fukuoka, both of Japan

[73] Assignees: Nippon Tungsten Co., Ltd., Fukuoka; Masahiro Okesaku, Ishikawa, both of Japan

[21] Appl. No.: 465,172

[22] PCT Filed: Jun. 27, 1989

[86] PCT No.: PCT/JP89/00634

§ 371 Date: Feb. 22, 1990

§ 102(e) Date: Feb. 22, 1990

[87] PCT Pub. No.: WO90/00211

PCT Pub. Date: Jan. 11, 1990

[30] Foreign Application Priority Data

Jul. 1, 1988 [JP] Japan ..... 63-164531

[51] Int. Cl.[5] ..... D03D 47/32

[52] U.S. Cl. ..... 139/435.4; 239/498

[58] Field of Search ..... 139/435.4, 302; 239/498, DIG. 19, 569, 583

[56] References Cited

U.S. PATENT DOCUMENTS

| | | | |
|---|---|---|---|
| 3,486,700 | 12/1969 | Bristow | 139/435.4 X |
| 4,253,611 | 3/1981 | Hart | 239/DIG. 19 X |
| 4,531,555 | 7/1985 | Tatematsu et al. | 139/302 X |
| 4,592,506 | 6/1986 | Capes et al. | 239/DIG. 19 X |

FOREIGN PATENT DOCUMENTS

| | | | |
|---|---|---|---|
| 34-20278 | 12/1959 | Japan . | |
| 52-12273 | 1/1977 | Japan . | |
| 53-19257 | 5/1978 | Japan . | |
| 61-41348 | 2/1986 | Japan | 139/435.4 |
| 61-113857 | 5/1986 | Japan | 139/435.4 |
| 61-155386 | 9/1986 | Japan . | |
| 62-88779 | 6/1987 | Japan . | |

*Primary Examiner*—Andrew M. Falik

*Attorney, Agent, or Firm*—Jordan and Hamburg

[57] ABSTRACT

A water jet nozzle for a loom includes a nozzle member having a rear end portion, an interior orifice formed in the rear end portion, a stabilizer integrally connected to the orifice for adjusting water flow in the rear end portion of the nozzle member and a needle arranged centrally of the orifice for feeding out a weft yarn. The orifice and stabilizer define an annular groove therebetween and are made of a material having a high hardness and high corrosion resistance. The orifice and stabilizer are preferably made of a material such as a cemented carbide, cermet, or ceramic having a modulus of elasticity of at least $1.5\times10^4$ kg/mm, an $H_RA$ hardness of at least 85 and a flexural strength of at least 50 kg/mm$^2$. The stabilizer is constructed of a plurality of elongated blades of equal width arranged in concentric parallel spaced relation to define therebetween a plurality of elongated slits of equal width arranged in concentric parallel spaced relation. The water jet nozzle is particularly useful for high-speed looms.

11 Claims, 3 Drawing Sheets

WATER JET NOZZLE FOR LOOM

The present invention relates to a water jet nozzle for use with a high-speed loom.

BACKGROUND OF THE INVENTION

Structures of water jet nozzles for use with a loom are disclosed in Japanese Utility Model Unexamined Publication (KOKAI) Nos. 61-155386 and 62-88779.

In recent years, as disclosed in these publications, a dominant type of water jet nozzle incorporates a stabilizer for straightening water flow of the water jet nozzle with speed-up in an automatic loom.

This type of prior art water jet nozzle, as shown in FIG. 5, is so constructed that an orifice E and a needle F inserted concentrically with the orifice E are provided at a top of a body D formed with a pool C communicating with a water injection hole B of a holder A. The structure of the water jet nozzle is such that the water injected via injection hole B of the holder A jets out from a gap between the orifice E and the needle F. The water jet nozzle performs a function to intermittently feed, between warps stretched from a tip of the needle F to an unillustrated loom, a weft yarn charged in from a cavity G of the needle F.

When feeding out the weft yarn, it is required that a jet flow formed in the path from the water injection hole B to the gap between the orifice E and the needle be rectified as much as possible.

For this straightening, a resinous stabilizer H having a construction shown in FIG. 6 is so disposed as to be contiguous to a rear end of the orifice E composed of hardened steel.

The resinous stabilizer H is manufactured simply by injection molding and also simply assembled by setting it in a space at a rear part of the orifice E made of hardened steel. The stabilizer H exhibits a remarkable effect for a loom having a weftwise feeding number of approximately 400–750 times/min under a water pressure of about 25 kg/cm$^2$.

With the further advancement of speeding up the loom in recent years, working conditions oriented thereto are that water pressure is 30–40 kg/cm$^2$; water flow rate reaches 30 –40 m/sec.; and the number of insertions of weft yarn exceeds 1000 times/min.

In the water jet nozzle equipped with a resinous stabilizer, the material of which the stabilizer is formed is insufficient in its hardness and strength, resulting in an intensive wear caused by the water flow and in a short life span thereof. Besides, it is impossible to set the thickness of a blade unit to 0.2 mm or under. At a high flow rate of more than 30 m/sec., the water pressure drops due to fluid resistance, and the weftwise feeding number is limited to 750 times/min. Under such conditions, it is absolutely impossible to achieve higher-speed feeding of the weft yarn.

In addition, vibrations and swirls are caused due to deformation of the stabilizer itself when the water flows at a high velocity. This situation in turn makes the insertions of weft yarn irregular, and there arise problems of causing both a drop in availability factor concomitant with a stagnation of the loom as well as a decline in the quality of fabrics woven.

The conventional water jet nozzle generates water jets from the orifice and needle, and the unit for feeding out the weft yarn is made at best of a hardened steel. Hence, wear resistance and corrosion resistance are not sufficient, as a result of which the device decreases in its life span and associated components have to be replaced. Not only does the resinous stabilizer conceived as a replaceable component decrease in availability factor, but also the loom itself is thereby reduced in the same factor.

In order to improve the wear resistance, a structure of embedding a cylindrical ceramic body in an inside diametrical part of the tip of the conventional needle made of hardened steel and bonding it thereto has been proposed. This structure, however, presents the problem of the ceramic body falling off during use.

SUMMARY OF THE INVENTION

Accordingly, it is a primary object of the present invention to provide a novel water jet nozzle for performing high-speed and stable weaving.

Another object of the present invention is to provide a water jet nozzle capable of reducing resistance caused by straightening of water jets.

Still another object of the present invention is to provide a water jet nozzle capable of improving hyperfine machinability of a needle tip and enhancing the function of the nozzle itself.

A water jet nozzle according to the present invention is constructed in such a way that a high pressure water flow from a needle and an orifice is jetted; a unit for feeding out a weft yarn is composed of a material having a high hardness and corrosion resistance; and the orifice is made integral with a stabilizer.

BRIEF DESCRIPTION OF THE DRAWINGS

The present invention will be better understood by reference to the accompanying drawings, in which.

Throughout the drawings, the numerals designate components as follows:

| | |
|---|---|
| 1: nozzle number | 2: body |
| 3: orifice | 4: annular groove |
| 5: stabilizer | 6: slit |
| 7: blade | 8: top end of blade |
| 9: needle | 10: top end of orifice |
| 11: inlet of orifice | 12: tapered portion |
| W: water injected | |

DESCRIPTION OF THE PREFERRED EMBODIMENTS

Suitable material of high hardness and corrosion resistance includes the use of sintered cemented carbides, cermets and ceramics. An arbitrary material can be employed on the condition that its modulus of elasticity is more than $1.5\times10^4$ kg/mm$^2$ and its hardness is $H_RA$ 85 or greater.

Since the stabilizer for straightening the injected water requires a hyperfine machinability, the flexural strength of suitable material is therefore 50 kg/mm$^2$, preferably 75 kg/mm$^2$ or larger.

To be specific, the sintered cemented carbides include materials grouped in accordance with JIS symbols, P, M, K, V and E which are used for cutting tools, wear resistant tools and mining tools. As cerments, there may be exemplified materials mainly composed of titanium carbide exhibiting strengths, wear resistance, corrosion resistance and a hyperfine machinability. These materials are effective in obviating the foregoing problems in the prior art.

Where ceramic materials are utilized, in the great majority of cases, they exhibit more excellent corrosion resistance and wear resistance than in the sintered cemented carbides and cermets. On the other hand, a good many ceramic materials are unsatisfactory in terms of their flexural strengths and are therefore to be selected depending on whether or not they exhibit a hyperfine machinability.

A wide variety of ceramic materials are prepared, i.e., $AL_2O_3$, $Si_3N_4$, $ZrO_2$ and SiC. Other materials chiefly composed of nitride, boride and carbide or composites obtained by mixing two or more kinds of these materials are also exemplified. In the case of machining the material to have a wall thickness of more than 0.1 mm, flexural strength is at least 50 kg/mm$^2$ or above. In the case of machining the material to have a wall thickness of 0.1 mm or under, the flexural strength is 75 kg/mm$^2$ or greater. Deterioration due to chips can be minimized by selecting the ceramic materials which meet such requirements.

A member formed of an $Si_3N_5$ group material or a $ZrO_2$ group material or formed of a composite obtained by adding other oxide, carbide, nitride and boride among the foregoing materials thereto is capable of providing a well-conditioned finish and decreasing the thickness of each blade of the stabilizer. Hence, it is possible to reduce resistance during straightening of the water jets, ameliorate hyperfine machinability of the needle tip and enhance the function of the nozzle itself.

Characteristics of the present invention will be described hereinafter in detail with reference to the accompanying drawings showing an embodiment thereof.

Figure 1:
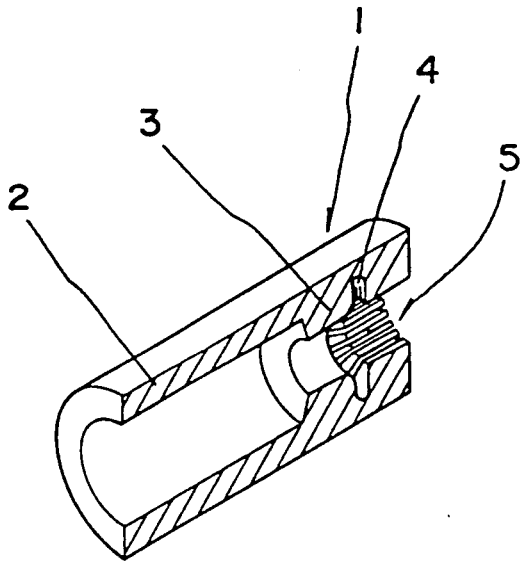
FIG. 1 is a sectional view in perspective of a nozzle member according to an embodiment of the present invention.

FIG. 1 is a view sectionally showing in perspective an outer shape of a nozzle member 1 according to the present invention. The nozzle member 1 is constructed such that, as illustrated in FIG. 1, a stabilizer 5 is integrally formed through an annular groove 4 for adjusting the water flow at the rear of an orifice 3 formed in an interior of a body 2 at its rear end.

Figure 2:
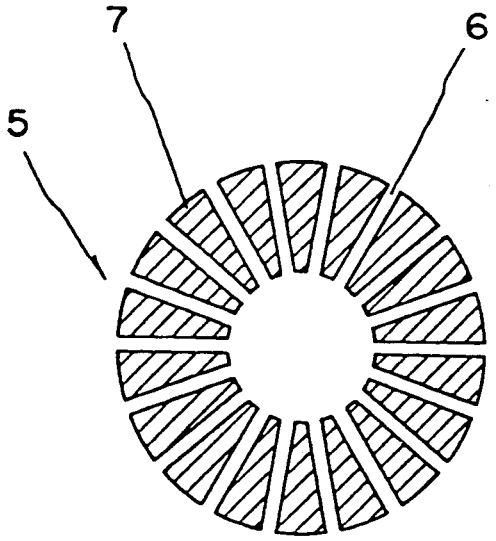
FIG. 2 is a cross-sectional view of the stabilizer shown in FIG. 1.

The stabilizer 5 is, as shown in section in FIG. 2, formed with more than 10 streaks of slits 6 each having the same width at equal spacings.

Equalization of the spacings between the slits is of great importance in terms of high-speed straightening of water flow. The best condition has been confirmed from experiments, wherein the number of slits each having a width of 0.5 mm is 16 to 18 when the number of revolutions of a loom is 900 rpm and the pump water pressure is 35 kg/cm$^2$.

To express this optimal configuration in terms of dimensions, the number of slits 6 should be adjusted depending on the size of the inside diameter of the stabilizer. In this case, the thickness of the top end of a blade 7 formed between slits 6, shown in FIG. 2, is 0.1 mm or under, preferably smaller than 0.05 mm. It is feasible to obtain a jet water flow having a higher convergence as it approaches a knife edge.

If a ceramic material such as zirconia is employed, it is possible to easily adjust the accuracy of the width to within ±0.01 mm, and accordingly the water jet flow generated in the orifice can be speeded up and controlled.

Figure 3:
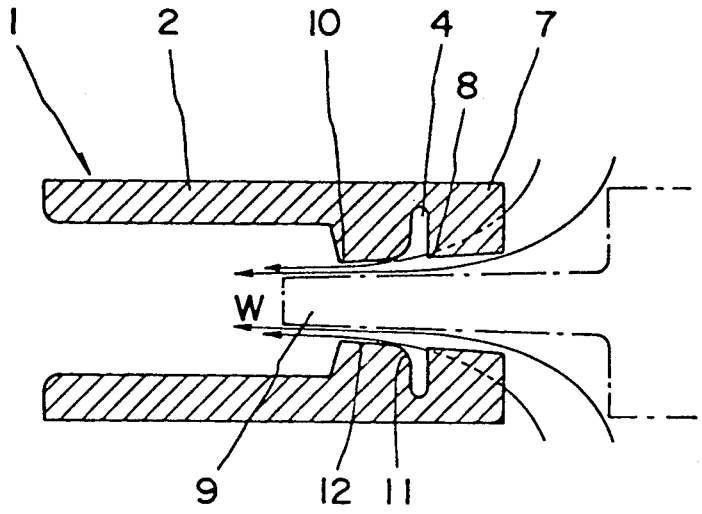
FIG. 3 is a sectional view of the nozzle member shown in FIG. 1 in conjunction with a needle.
Figure 4:
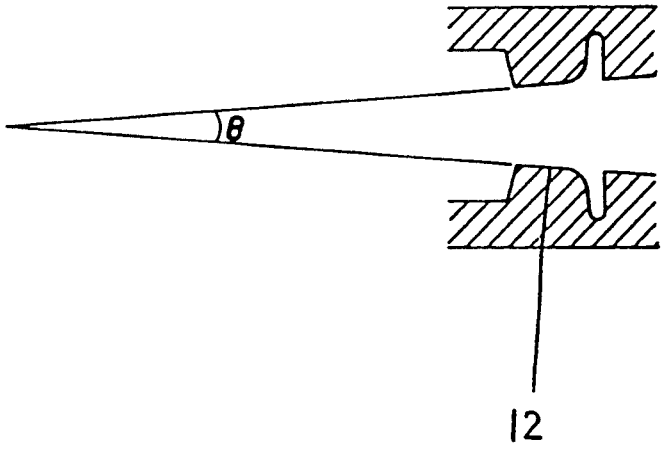
FIG. 4 is a sectional schematic illustration of a tapered portion of the nozzle member.
Figure 5:
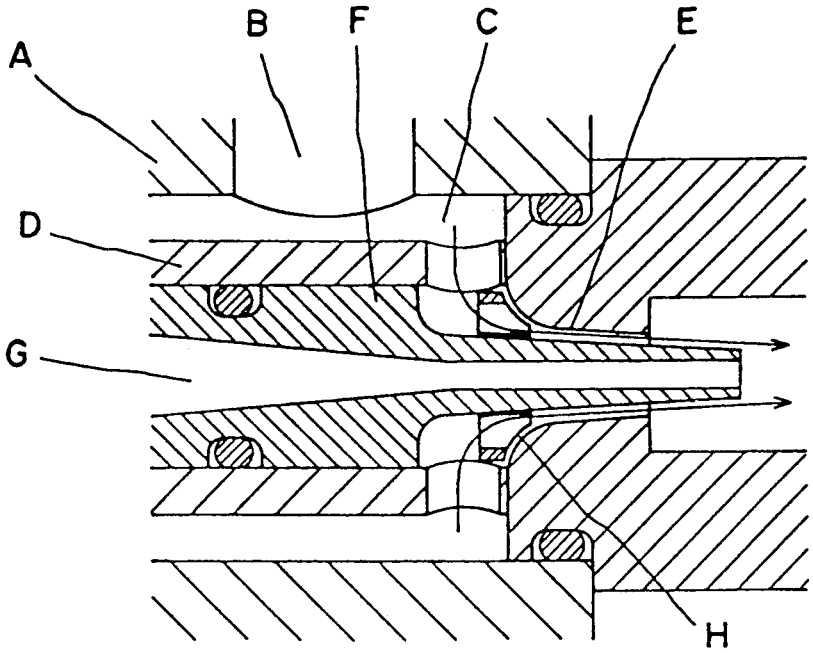
FIG. 5 PRIOR ART
FIG. 5 is a sectional view of a water jet nozzle according to the prior art.
Figure 6:
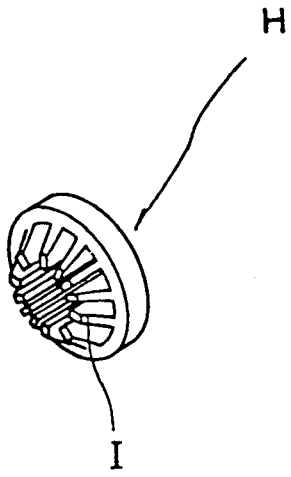
FIG. 6 PRIOR ART
FIG. 6 is a perspective view of a resinous stabilizer for a water jet nozzle of the prior art.

Turning to FIG. 3, illustrating a sectional configuration of the nozzle member 1 including an integrally formed orifice and stabilizer, a thickness of an outside diameter of each of the blades 7 for shaping the slits 6 of the stabilizer 5 is set preferably to 0.5 mm through 1.2 mm. A top end 8 of the blade 7 may be formed at a right angle or another angle or be rounded with a radius. However, a preferable formation thereof eliminates the possibility of producing chips. A corner of an orifice inlet 11 facing an annular groove 4 formed to reduce the resistance of a rectified water pressure is formed in a round shape having a radius of at least 0.5 mm. An angle $\theta$ of a tapered portion 12 is, as illustrated in FIG. 4, set at 6° through 11°, and it follows that subsequent water jet flows are effectively generated. Referring to FIG. 3, the numeral 9 represents a needle for feeding out the weft yarn set in a central opening of the orifice 3 of the nozzle member 1 as well as in a central part of the stabilizer 5 shown in FIG. 1.

Injected water W completely rectified by the stabilizer 5 in cooperation with the annular groove 4 is jetted between the needle 9 and the orifice 3. When jetting the water W, an edge angle of a top end 10 of the orifice 3 is preferably larger than 90° under such a condition that the rectified water W runs at a high flow rate of 30–40 m/sec. More preferably, the edge angle is set at 95° to 115°, with the result that a water jet flow having a good convergence can be attained without splitting the flow. An additional condition for obtaining a highly convergent water jet flow is that the edge portion having an angle of 95° through 115° is shaped to provide a smooth surface without producing chips to the greatest possible degree.

The water jet nozzle assuming configurations shown in the foregoing figures is composed of partially-stabilized zirconia and many other materials in the manner discussed above and is applied to a loom in which synthetic long fibers are arranged with a taffeta width of 1200–1800 mm. In this case, weaving can be effected at a higher velocity of 200–400 times/min (approximately 1.5-fold velocity) than in the conventional nozzle.

In the prior art, a sizing process of the warp is needed because of hair-rising thereof. As a result of effecting the operation by use of the nozzle of this invention, well-conditioned fabrics can be obtained with no hair-rising. A probability of non-sizing can be realized depending on types of textiles employed.

The present invention yields the following advantages:

(1) The nozzle member constructed of the stabilizer and the orifice which are formed integrally and the needle are made of the materials of high hardness and corrosion resistance, thereby exhibiting a long stretch of durability against hyperfast water jets generated therein;

(2) Since the stabilizer is shaped integrally with the orifice, the nozzle can simply be assembled and adjusted;

(3) A functional correlation between the nozzle member comprising the stabilizer and the orifice integral therewith and the needle can be established, and a more accurate nozzle function can thereby be expected;

(4) A higher speed water flow than in the prior art can be obtained with a lesser amount of water;

(5) The insertion of weft yarn can be performed stably at a high velocity, which markedly reduces lack of uniformity of weaving; and (6) Labor for maintenance is considerably reduced, and the availability factor of the loom is outstandingly improved.

The water jet nozzle of the present invention can be applied to a high-speed loom by which fabrics that are required to have a high quality are manufactured.

We claim:

1. A water jet nozzle for a loom comprising a nozzle member having a rear end portion; orifice means defining an interior orifice in said rear end portion; stabilizer means integrally connected to said orifice means for adjusting water flow in said rear end portion of said nozzle member, said orifice means and said stabilizer means defining an annular groove therebetween and being made of a material having a high hardness and high corrosion resistance; and a needle arranged centrally of said orifice means for feeding out a weft yarn.

2. A water jet nozzle as in claim 1, wherein said material of said orifice means and said stabilizer means is selected from the group consisting of cemented carbides, cermets and ceramics having a modulus of elasticity greater than $1.5\times10^4$ kg/mm, an $H_RA$ hardness of at least 85, and a flexural strength of at least 50 kgmm$^2$.

3. A water jet nozzle as in claim 2, wherein said material has a flexural strength of at least 75 kg/mm$^2$.

4. A water jet nozzle as in claim 1, wherein said material of said orifice means and said stabilizer means comprises partially-stabilized zirconia.

5. A water jet nozzle as in claim 1, wherein said stabilizer means comprises a plurality of elongated blades of equal width arranged in concentric parallel spaced relation, said blades defining therebetween a plurality of elongated slits of equal width arranged in concentric parallel spaced relation.

6. A water jet nozzle as in claim 5, wherein each of said plurality of blades tapers radially inwardly from a relatively wider outer end to a relatively narrower inner end.

7. A water jet nozzle as in claim 6, wherein the outer end of each of said plurality of blades has a width ranging from 0.5 mm to 1.2 mm, and the inner end of each of said plurality of blades has a width of no greater than 0.1 mm.

8. A water jet nozzle as in claim 1, wherein said orifice means tapers inwardly from said rear end portion of said nozzle member.

9. A water jet nozzle as in claim 8, wherein said orifice means tapers inwardly at an angle ranging from 6° to 11°.

10. A water jet nozzle as in claim 1, wherein said orifice means further comprises a front edge having an angle of at least 90° and a rear edge facing said angular groove and having a round shape with a radius of at least 0.5 mm.

11. A water jet nozzle as in claim 10, wherein said front edge has an angle of 95° to 115°.

* * * * *